US008646671B2

(12) United States Patent
Adams

(10) Patent No.: US 8,646,671 B2
(45) Date of Patent: Feb. 11, 2014

(54) COMBUSTION CHAMBER AND COOLING SYSTEM FOR FASTENER-DRIVING TOOLS

(75) Inventor: Joseph S. Adams, Saltspring Island (CA)

(73) Assignee: Illinois Tool Works Inc., Glenview, IL (US)

( * ) Notice: Subject to any disclaimer, the term of this patent is extended or adjusted under 35 U.S.C. 154(b) by 489 days.

(21) Appl. No.: 12/811,546

(22) PCT Filed: Dec. 31, 2008

(86) PCT No.: PCT/US2008/088593

§ 371 (c)(1),
(2), (4) Date: Sep. 9, 2010

(87) PCT Pub. No.: WO2009/088896

PCT Pub. Date: Jul. 16, 2009

(65) Prior Publication Data

US 2010/0327039 A1 Dec. 30, 2010

Related U.S. Application Data

(60) Provisional application No. 61/006,304, filed on Jan. 4, 2008.

(51) Int. Cl.
*B25C 1/08* (2006.01)

(52) U.S. Cl.
USPC ..... 227/10; 227/8; 123/46 SC; 123/41.63; 123/41.64; 123/41.7; 123/540; 123/542; 123/184.52

(58) Field of Classification Search
USPC ..... 227/8, 10; 123/46 SC, 41.63, 540, 542, 123/559, 184.1, 184.52, 184.54, 41.64, 41.7
See application file for complete search history.

(56) References Cited

U.S. PATENT DOCUMENTS

| | | | | |
|---|---|---|---|---|
| 2,046,252 | A * | 6/1936 | Davis | 181/283 |
| 3,814,069 | A * | 6/1974 | Croft et al. | 123/184.42 |
| 4,093,110 | A * | 6/1978 | Johnson | 227/9 |
| 5,090,606 | A | 2/1992 | Torii et al. | |
| 5,713,313 | A | 2/1998 | Berry | |
| 6,213,370 | B1 | 4/2001 | Walter | |
| 2005/0247276 | A1 * | 11/2005 | Hirai et al. | 123/46 R |

(Continued)

FOREIGN PATENT DOCUMENTS

| | | | |
|---|---|---|---|
| EP | 0424941 | A1 | 5/1991 |
| EP | 1914042 | A1 | 4/2008 |
| WO | 2005/063449 | A1 | 7/2005 |
| WO | 2007/048006 | A2 | 4/2007 |

OTHER PUBLICATIONS

ISR for PCT/US2008/088593 dated Apr. 20, 2009.

*Primary Examiner* — Michelle Lopez
(74) *Attorney, Agent, or Firm* — Lowe Hauptman & Ham, LLP

(57) ABSTRACT

A new and improved combustion chamber and cooling system for a fastener-driving tool wherein a new and improved tangentially oriented, vortex induced fuel-injection system is operatively associated with the tool's combustion chamber. In addition, a new and improved trigger-controlled valve actuating system, such as, for example, a switch-operated, solenoid-actuated valve-controlling system, is incorporated within the tool so as to ensure the rapid operation of the intake and outlet valve structures. Still further, a sealed, liquid evaporative or liquid recirculating cooling system is integrally incorporated within the tool housing.

16 Claims, 6 Drawing Sheets

(56) References Cited

U.S. PATENT DOCUMENTS

2006/0237513 A1* 10/2006 Tanaka et al. ..... 227/10
2008/0217372 A1 9/2008 Webb
2009/0250499 A1* 10/2009 Hahn et al. ..... 227/10
2011/0005502 A1* 1/2011 Adams ..... 123/559.1

* cited by examiner

COMBUSTION CHAMBER AND COOLING SYSTEM FOR FASTENER-DRIVING TOOLS

CROSS-REFERENCE TO RELATED PATENT APPLICATION

The present application is national phase of PCT/US2008/088593 filed Dec. 31, 2008, and claims priority from U.S. Application No. 61/006,304 filed Jan. 4, 2008, the disclosures of which are hereby incorporated by reference herein in their entirety.

FIELD OF THE INVENTION

The present invention relates generally to fastener-driving tools, and more particularly to a new and improved combustion chamber and cooling system for a fastener-driving tool wherein a new and improved tangentially oriented, vortex induced fuel-injection system is incorporated into or operatively associated with the tool's combustion chamber in order to enhance the mixing of the air-fuel mixture and to accelerate the combustion process within the combustion chamber so as to effectively reduce the time required from spark ignition to achieving peak combustion pressure within the combustion chamber, wherein a new and improved trigger-controlled valve actuating system, such as, for example, a switch-operated, solenoid-actuated valve-controlling system, is incorporated within the tool so as to ensure the rapid operation of the intake and outlet valve structures in order to, in turn, minimize tool firing operational cycles such that the new and improved combustion-powered fastener-driving tool can be operationally competitive with respect to conventional pneumatically-powered fastener-driving tools, wherein a sealed, liquid evaporative or liquid recirculating cooling system is integrally incorporated within the tool housing, and wherein the new and improved tangentially oriented, vortex-induced fuel-injection system is also effectively utilized to scavenge the combustion exhaust products out from the combustion chamber as well as to cool the tool.

BACKGROUND OF THE INVENTION

In conventional, PRIOR ART combustion-powered fasten-driving tools, such as, for example, as is disclosed within U.S. Pat. No. Re. 32,452 which issued to Nikolich on Jul. 7, 1987, a fan is often incorporated within the upper region of the combustion chamber for any one of several reasons, such as, for example, facilitating or assisting the mixture of the air and fuel components being injected into the combustion chamber prior to ignition, providing a turbulent atmosphere within the combustion chamber in order to in fact promote the rapid burning of the air-fuel mixture within the combustion chamber once ignition has been initiated, scavenging of the combustion exhaust products by means of fresh air being induced into the combustion chamber subsequent to the combustion and power stroke phases of the fastener-driving tool, and cooling of the tool. However, it has been realized that the disposition of the fan at its substantially upper axial location within the combustion chamber is not in fact ideal in view of the thermal environment, as well as the pressure or shock forces, to which the fan is normally subjected over extended operational periods. Accordingly, relatively small and low-mass fans are normally required to be used, as well as relatively sophisticated mounting systems for the fans in order to permit the same to withstand the aforenoted pressure or shock forces attendant each combustion cycle. It might therefore be desirable to relocate the fan to an alternate position, such as, for example, external to the combustion chamber, however, this then becomes problematic in that alternate means or modes of operation must be provided in order to achieve the mixing of the air and fuel components within the combustion chamber prior to the initiation of an ignition cycle, the development of turbulent conditions within the combustion chamber in order to facilitate the rapid burning of the air-fuel mixture within the combustion chamber, the induction of fresh air into the combustion chamber in order to achieve scavenging of the combustion exhaust products out from the combustion chamber subsequent to the combustion and power stroke phases of the fastener-driving tool, and the cooling of the tool.

Continuing still further, it is also noted that in order to achieve acceptable or desirable tool firing and fastener-driving cyclical operational rates, relatively large air intake and combustion product exhaust port and valve structures have also been structurally and operationally incorporated within such fastener-driving tools as a result of the use or employment of longitudinally or axially sliding combustion chamber structures or sections as is also disclosed, for example, within the aforenoted fastener-driving tool of Nikolich. It can be readily appreciated, however, that as a result of such sliding combustion chamber structure, auxiliary cooling structure or devices cannot be readily incorporated upon or operatively associated with the combustion chamber. In addition, as a result of the longitudinally or axially sliding movements of such combustion chamber components, the opening and closing of the air inlet and combustion product exhaust ports and valves is directly dependent upon the axial or longitudinal movements or strokes of the sliding combustion chamber structure. Accordingly, it has been experienced that the operational cycles of such conventional combustion-powered fastener-driving tools are slower than conventional pneumatically-powered fastener-driving tools. Still yet further, it is also noted that in typically conventional PRIOR ART fastener-driving tools, such as, for example, that disclosed within Nikolich, that the fuel is injected into the combustion chamber at only a single location. This structural arrangement also militates against the rapid uniform distribution and combustion of the fuel within and throughout the combustion chamber.

Still further, it is important in connection with such fastener-driving tools that adequate cooling of the same is provided. U.S. Pat. No. 6,968,811, which issued to Rosenbaum on Nov. 29, 2005, discloses an unsealed evaporative type cooling system, however, since such a system relies upon the evaporation of water as a result of the phase change at 212° F., this temperature is higher than desired in order to prolong the service life of the tool. In addition, since the water is constantly being evaporated and vented to atmosphere, there is a loss factor to be considered and the constant need for replenishment of the liquid supply. Still further, the use of other liquids is obviously not feasible since one would not normally want to discharge vapors from liquids, other than water, into the atmosphere.

A need therefore exists in the art for a new and improved combustion-powered fastener-driving tool wherein the cooling of the tool, the distribution and mixing of the air and fuel components within the combustion chamber of the tool, and the scavenging of the combustion exhaust products out from the combustion chamber can be achieved by means other than as the result of the disposition of a rotary fan within the upper region of the combustion chamber. A need also exists in the art for a new and improved combustion-powered fastener-driving tool wherein the fuel can be uniformly introduced into, and distributed throughout, the tool combustion chamber so as to effectively accelerate the combustion of the same and the attainment of the peak combustion pressure within the combustion chamber. Furthermore, a need exists in the art for a new and improved combustion-powered fastener-driving tool wherein the opening and closing of the intake and exhaust valves can be assuredly achieved in a rapid manner such that the cyclic operations of the combustion-powered fastener-driving tool can be comparable to those characteristic of conventional pneumatically-operated fastener-driving tools. Still further, a need exists in the art for a new and improved supplemental cooling system in addition to, for example, air cooling of the fastener-driving tool, as may be necessary.

SUMMARY OF THE INVENTION

The foregoing and other objectives are achieved in accordance with the teachings and principles of the present invention through the provision of a new and improved combustion-powered fastener-driving tool which comprises a combustion chamber having an exhaust valve disposed within the axially central upper region thereof. A dual, substantially concentrically disposed air intake duct is operatively associated with the combustion chamber such that a first portion of the incoming air, controlled by means of an intake valve, is conducted through the inner air intake duct so as to be conducted into the combustion chamber in a substantially tangential manner whereby the incoming air flows around the internal peripheral wall surface of the combustion chamber in, for example, a clockwise manner for combustion or scavenging purposes. A second portion of the incoming air is conducted through the annual spaced defined between the inner air intake duct and the outer air intake duct so as to be conducted into an annular space defined between the external wall surface of the combustion chamber and an external housing integrally formed with the outer air intake duct whereby cooling of the combustion chamber is achieved. One or more fuel injectors are also disposed within the combustion chamber so as to inject the fuel into the combustion chamber in, for example, the clockwise direction whereby the tangential or vortex type flow of the incoming air and injected fuel within the combustion chamber enhances the mixing thereof, the uniform distribution thereof, and the combustion of the same so as to maximize power within a relatively short period of time. Additional cooling systems, comprising, for example, a sealed, recirculating, liquid evaporative or pump-driven liquid cooling system, the employment of finned and heat exchanger structure, and the like, are also utilized. Lastly, in order to minimize the tool firing cycles, the air intake and exhaust valves, the fuel injectors, and the ignition spark plug are controlled by means of a trigger-controlled solenoid-switch system.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
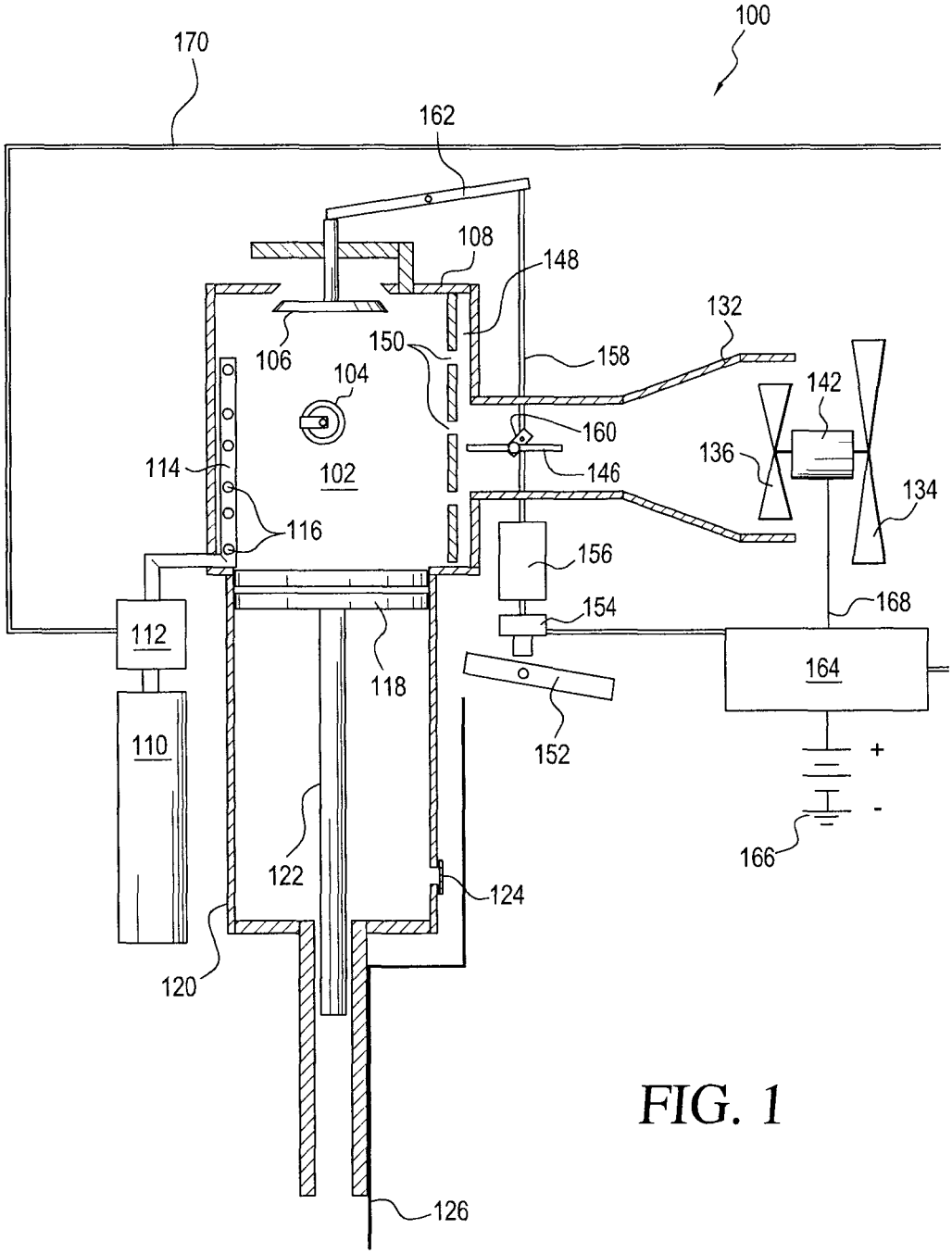
FIG. 1 is a schematic, vertical cross-sectional view of a first embodiment of a new and improved fastener-driving tool as constructed in accordance with the principles and teachings of the present invention and showing the cooperative parts thereof.
Figure 2:
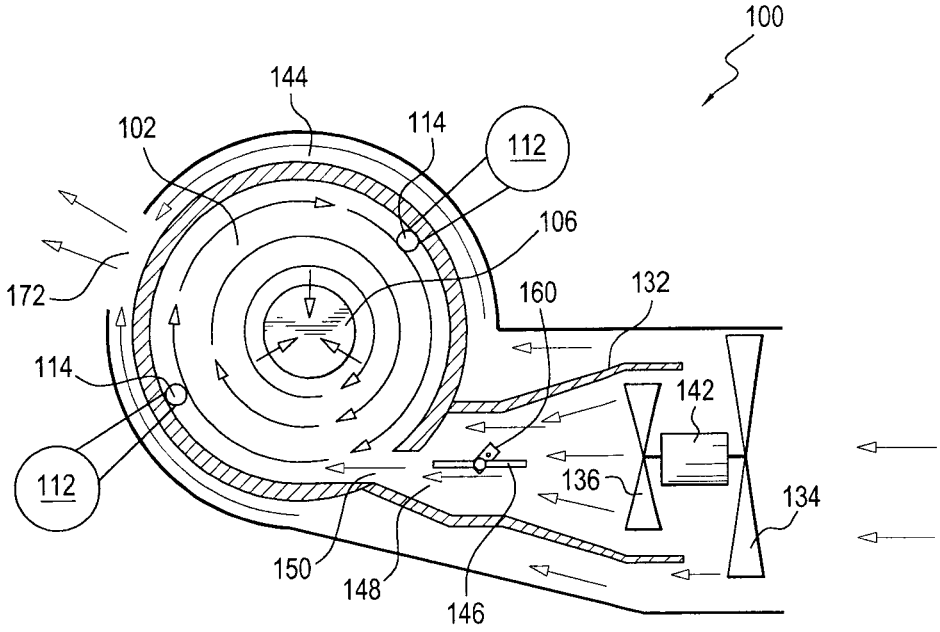
FIG. 2 is a schematic horizontal cross-sectional view of the new and improved fastener-driving tool, as disclosed within FIG. 1, wherein the air intake valve and the exhaust valve are both disposed in their open positions so as to achieve scavenging of the combustion products out from the combustion chamber.
Figure 3:
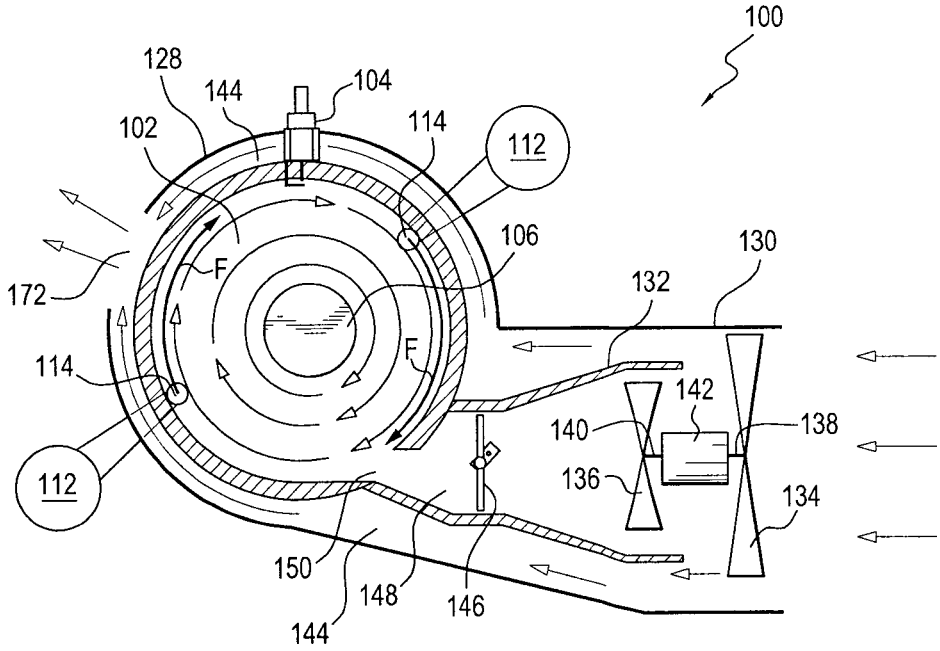
FIG. 3 is a schematic horizontal cross-sectional view of the new and improved fastener-driving tool, as disclosed within FIG. 2, wherein, however, the air intake valve and the exhaust valve are both disposed in their closed positions during the combustion cycle of the fastener-driving tool.

Referring now to the drawings, and more particularly to FIGS. 1-3 thereof, a first embodiment of a new and improved fastener-driving tool, as constructed in accordance with the principles and teachings of the present invention and showing the cooperative parts thereof, is disclosed and is generally indicated by the reference character 100. More particularly, it is seen that the first embodiment of the new and improved fastener-driving tool 100 comprises a combustion chamber 102 having an ignition device, such as, for example, a spark plug 104 disposed within a side wall portion thereof, and an exhaust scavenging valve 106 which is reciprocally movable in the vertical direction with respect to the upper wall member 108 of the combustion chamber 102 so as to be movable between an opened position and a closed position. In addition, the fastener-driving tool 100 is provided with one or more fuel supplies 110, one or more fuel injectors 112 fluidically connected to the one or more fuel supplies 110, and one or more, vertically extending fuel manifolds 114 disposed at circumferentially spaced positions located internally of the combustion chamber 102, wherein each one of the fuel manifolds 114 comprises a multiplicity of vertically spaced fuel discharge ports 116 so as to facilitate the rapid mixing and uniform distribution of the injected fuel throughout the combustion chamber 102.

It is to be noted that the fuel injected into the combustion chamber 102 from the plurality of fuel discharge ports 116 of the fuel manifolds 114 is injected in a tangential clockwise manner, as can best be appreciated from FIG. 3, the fuel being designated F, so as to cause the injected fuel to commence and attain a swirling or vortex type flow pattern within the combustion chamber 102. A working piston 118 is disposed within a cylinder member 120, and the upper surface portion of the working piston 118 is exposed to the interior of the combustion chamber 102. The piston 118 has a driver blade or driver member 122 attached to the undersurface portion thereof wherein the driver blade or member 122 is adapted to drive a fastener out from the fastener-driving tool 100 when the working piston 118 is forced downwardly within the cylinder member 120 by means of the forces generated within the combustion chamber 102 as a result of the ignition of the air-fuel mixture within the combustion chamber 102. An exhaust check valve 124 is disposed within a side wall portion of the cylinder member 120 so as to permit, in addition to other functions, a portion of the air, entrapped within the cylinder member 120 and beneath the piston 118, to escape when the piston 118 is undergoing its vertically down-ward movement, and a workpiece contact member or element 126 is movably disposed upon the lower end portion of the tool so as to contact a workpiece when a fastener-driving operation is to be initiated.

As can best be appreciated from FIGS. 2 and 3, the combustion chamber 102 is disposed internally, in a substantially concentric manner, within an outer housing 128, and in accordance with the principles and teachings of the present invention, the outer housing 128 has a first outer air intake duct 130 extending outwardly from a side wall portion thereof. A second inner air intake duct 132 is disposed substantially concentrically within the first air intake duct 130, and it is also seen that first and second air intake fans 134,136 are mounted upon and driven by a pair of motor output shafts 138,140 of a drive motor 142. In addition, the first and second air intake fans 134,136 are respectively disposed within the first outer and second inner air intake ducts 130,132 such that the first air intake fan 134 not only cooperates with the second air intake fan 136 in providing intake air into the second inner air intake duct 132, but in addition, provides cooling air for the drive motor 142 as well as circulating air into the annular space 144 defined between the first outer and second inner air intake ducts 130,132 so as to provide cooling for the combustion chamber 102. It is also seen that the second inner air intake duct 132 has an air intake valve 146 disposed within the downstream end portion thereof, and that the downstream end portion of the second inner air intake duct 132 is integrally connected to a vertically oriented air intake manifold 148 as might best be appreciated from FIG. 1. In turn, the air intake manifold 148 is operatively associated with a side wall portion of the combustion chamber 102 within which there is provided a plurality of vertically spaced air inlet ports 150 whereby the air entering the combustion chamber 102 does not simply enter the same through means of a single air inlet port but, to the contrary, through means of a multiplicity of inlet ports throughout the vertical extent of the combustion chamber 102.

It is to be further understood, as can best be appreciated from FIGS. 2 and 3, that the air inlet ports 150 are effectively formed within the side wall portion of the combustion chamber 102 such that the incoming air effectively comes into or enters the combustion chamber 102 in a substantially tangential manner. Accordingly, not only will such incoming air enter the combustion level through means of the multiplicity of air inlet ports throughout the vertical extent of the combustion chamber 102, but in addition, the incoming air will flow in a swirling or vortex type pattern within the combustion chamber 102 and will thoroughly mix with the similarly flowing fuel, injected from the multiplicity of vertically spaced fuel discharge ports 116 of the fuel manifolds 114, throughout all regions of the combustion chamber 102 when fuel is in fact injected into the combustion chamber 102 for initiation of a combustion phase of the tool firing cycle. It is to be similarly noted that during the non-combustion phase of the tool operating cycle, the incoming swirling or vortex flowing air will serve to efficiently scavenge combustion products throughout all regions of the combustion chamber 102.

With reference again being made to FIG. 1, it is also seen that the fastener-driving tool 100 comprises a trigger mechanism 152 which is adapted to be operatively associated with the workpiece contact member or element 126 in order to initiate firing of the fastener-driving tool 100 in either one of two modes of operation, and that the trigger mechanism 152 is operatively associated with a switch mechanism 154. A first mode of operation is known as a sequential mode of operation wherein the fastener-driving tool 100 is continuously disposed in contact with a workpiece such that the workpiece contact member or element 126 is moved to an upper position with respect to, for example, the cylinder member 120, and then each time the trigger mechanism 152 is moved to an upper position so as to be actuated, the fastener-driving tool 100 will be fired. The second mode of operation is known as a bump-firing mode of operation wherein the trigger mechanism 152 is always maintained at its upper position, and then each time the workpiece contact member or element 126 is moved to its upper position, as a result of being engaged with a workpiece, the fastener-driving tool 100 will be fired. It is to be appreciated that as a safety procedure, and regardless of which mode of operation is being used to fire the fastener-driving tool 100, both the workpiece contact member or element 126 and the trigger mechanism 152 must simultaneously be disposed at their upper positions in order for the switch mechanism 154 to in fact be actuated. In accordance with principles and teachings of the present invention, the switch mechanism 154 is also electrically connected to a solenoid 156, and it is seen that the solenoid 156 is operatively connected to the air intake valve 146 through means of a linkage member 158 and an actuator arm 160. It is also seen that the distal end of the linkage member 158 is operatively connected to the exhaust scavenging valve 106 through means of a pivotally mounted lever arm 162. Still further, the switch mechanism 154 is operatively connected to a controller 164, which may be, for example, a programmable logic controller (PLC), and the controller 164 is electrically connected to a suitable power source 166. In addition, the controller 164 is electrically connected to the drive motor 142 by means of a suitable signal line 168, and is also electrically connected to the fuel injectors 112 by means of a suitable signal line 170. Still further, the controller 164 is adapted to likewise be electrically connected to the ignition device 104 by means of a suitable signal line, not shown for clarity purposes.

It can therefore be appreciated that in operation, after, for example, the fastener-driving tool 100 has been fired, and either the workpiece contact member or element 126 has been disengaged from the workpiece whereby the workpiece contact member or element 126 will be returned to its lower inoperative position, or the trigger mechanism 152 has been released from its upper, actuated position so as to likewise be returned to its lower, deactuated position, depending upon the mode of operation in which the fastener-driving tool 100 is being operated, the switch mechanism 154 will be deactuated, the solenoid 156 will be deactuated, and the linkage member 158 will be moved upwardly to the position illustrated in FIG. 1 whereby air intake valve 146 and the exhaust scavenging valve 106 will be respectively moved to their open positions, as are also illustrated in FIG. 1, such that incoming air will enter the combustion chamber 102 through means of the second inner air intake duct 132, the air intake manifold 148, and the air inlet ports 150, as a result of the driving of the second air intake fan 136 by means of the mot- or 142 as controlled by means of the controller 164. In addition, combustion exhaust products within the combustion chamber 102 will be exhausted through means of the exhaust scavenging valve 106, and cooling air will be circulated through the annular space 144 surrounding the combustion chamber 102, so as to be exhausted through means of a cooling air outlet port 172, as a result of the operation of the first air intake fan 134 by means of the motor 142 as controlled by means of the controller 164.

Conversely, when the fastener-driving tool 100 is to again be fired, as a result of both the workpiece contact member or element 126 and the trigger mechanism 152 being disposed at their upper actuated positions, the switch mechanism 154 is actuated so as to generate a signal to the controller (PLC) 164 which, in turn, actuates the solenoid 156 in a reverse manner, and accordingly, the linkage member 158 will be moved downwardly as viewed in FIG. 1 so as to move both the exhaust scavenging valve 106 and the air intake valve 146 to their closed positions as illustrated in FIG. 3. In addition, the controller 164, receiving a suitable signal from the switch mechanism 154, will send a suitable control signal to the fuel injectors 112 so as to initiate fuel injection into the combustion chamber 102 such that the fuel can mix with the incoming air which has just entered the combustion chamber 102 prior to the closing of the air intake valve 146.

In addition, the controller 164 will also control the activation of the spark plug 104 in a time-controlled manner so as to initiate ignition and combustion of the air-fuel mixture within the combustion chamber 102. It is therefore to be appreciated that as a result of the operative connection of the exhaust scavenging valve 106 and the air intake valve 146 to the solenoid 156, extremely quick movements of such valves 106,146 between their open and closed positions can in fact be achieved so as to effectively minimize the fastener-driving tool operational cycle times. It is to be noted that in order to maximize the cooling of the tool 100, or to at least constantly be cooling the tool 100, the controller 164 can maintain the motor drive 142 active, even when the tool 100 is not actually being used any particular moment in time, so as to continuously operate the fans 134, 136 whereby air is being, in effect, continuously inducted. A suitable temperature or thermal heat sensor, not shown, can of course be utilized to send a signal to the controller 164 to terminate operation of the drive motor 142 when the tool reaches a desirably cooled temperature level.

Figure 4:
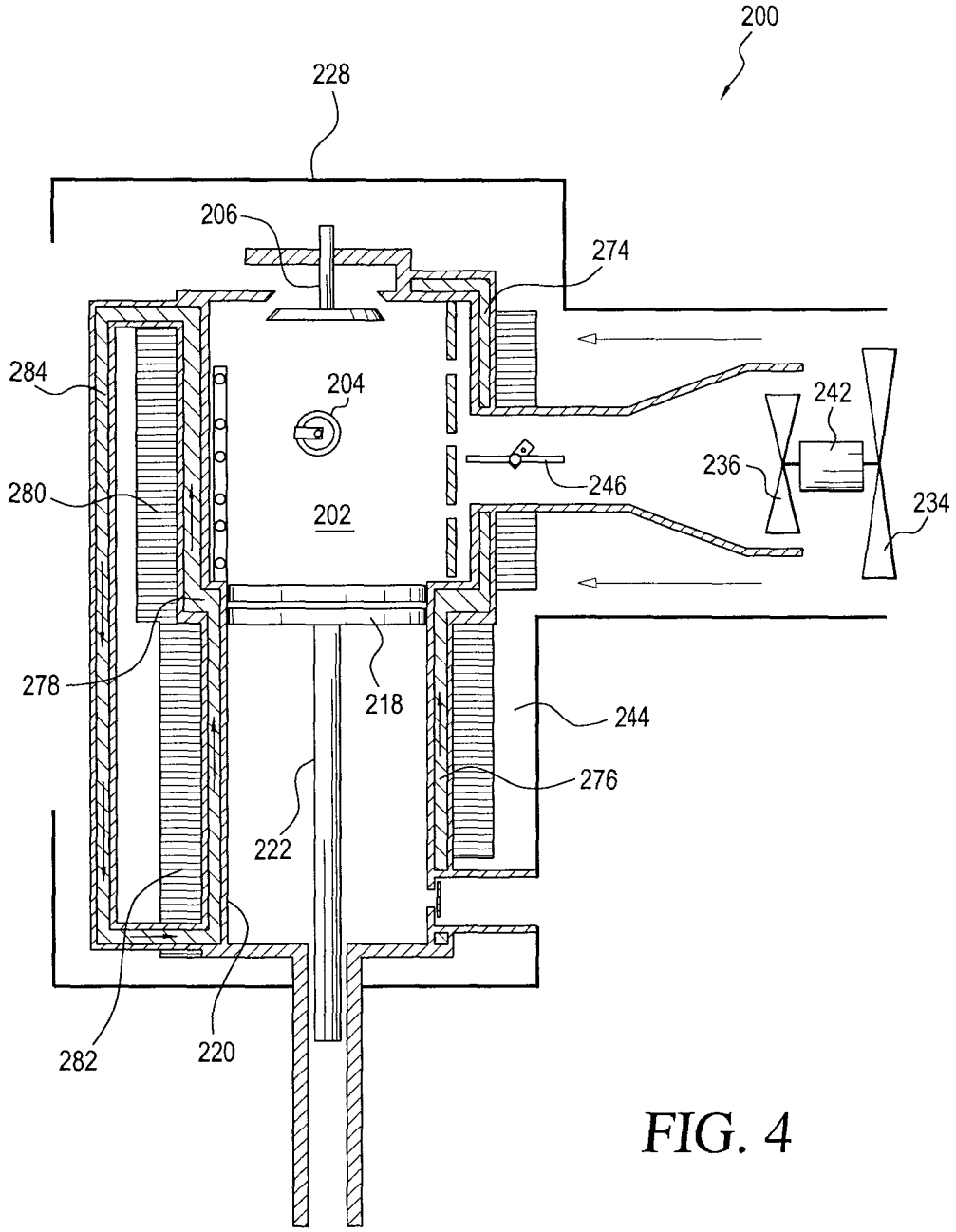
FIG. 4 is a schematic, vertical cross-sectional view, similar to that of FIG. 1, showing, however, a second embodiment of a new and improved fastener-driving tool as constructed in accordance with further principles and teachings of the present invention and showing the cooperative parts thereof, wherein a sealed, recirculating liquid evaporation cooling system and cooling fin structure has effectively been operatively associated with the combustion chamber and cylinder member of the fastener-driving tool.

With reference now being made to FIG. 4, a second embodiment of a new and improved fastener-driving tool, as constructed in accordance with further principles and teachings of the present invention and showing the cooperative parts thereof, is disclosed and is generally indicated by the reference character 200. It is to be noted that the second embodiment fastener-driving tool 200 as disclosed within FIG. 4 is operationally similar to the first embodiment fastener-driving tool 100 as disclosed within FIGS. 1-3, except as will be noted hereafter, and accordingly component parts of the second embodiment fastener-driving tool 200 that correspond to component parts of the first embodiment fastener-driving tool 100 will be denoted by corresponding reference characters except that they will be in the 200 series. More particularly, it is seen that the primary difference between the second embodiment fastener-driving tool 200 and the first embodiment fastener-driving tool 100 resides in the fact that a sealed, recirculating liquid cooling system and cooling fin structure has effectively been operatively associated with the combustion chamber 202 and cylinder member 220 of the fastener-driving tool 200. More specifically, it is seen that, in addition to the cooling air which is circulating within the annular space 244 defined between the outer housing 228 and the combustion chamber 202 and cylinder member 220 structure by means of the first air intake fan 234, a first annular space or chamber 274 is effectively defined or formed upon the external periphery of the combustion chamber 202, and a second annular space or chamber 276 is similarly defined or formed upon the external periphery of the cylinder member 220 such that an upper region of the second annular space or chamber 276 is fluidically connected to a lower region of the first annular space or chamber 274 by means of an annular transition region 278. In addition, it is seen that a first set of annular cooling fins 280 project radially outwardly from the external periphery of the housing structure defining the first annular space or chamber 274, and in a similar manner, a second set of annular cooling fins 282 project radially outwardly from the external periphery of the housing structure defining the second annular space or chamber 276. Furthermore, it is also seen that opposite ends of a recirculation passage 284 are fluidically connected to the upper end portion of the first annular space or chamber 274 and to the lower end portion of the second annular space or chamber 276. A suitable fabric or wick-type material is disposed within the first and second annular chambers 274,276 in order to enhance the retention of a liquid therewithin, and the entire recirculation system, comprising the first and second annular chambers 274,276 and the recirculation passage 284, is partially filled with a suitable liquid, such as, for example, alcohol.

Accordingly, it can be appreciated that as heat is radiated outwardly from the combustion chamber 202 as a result of the ignition and combustion of the air-fuel mixture within the combustion chamber 202 during a combustion part of the operational cycle, the liquid disposed within the first annular chamber 274 will be boiled off and the vapors will flow upwardly and into the upper end portion of the recirculation passage 284. The vapors will then flow downwardly within the recirculation passage 284 and tend to condense back to the liquid state as the vapors reach the relatively cooler portion of the tool 200, and subsequently, the liquid will be conducted upwardly within the fabric or wick-type material disposed within the second and first annular chambers 276,274, after passing through the annular transition region 278, so as to repeat the evaporative, recirculating cooling process.

Figure 5:
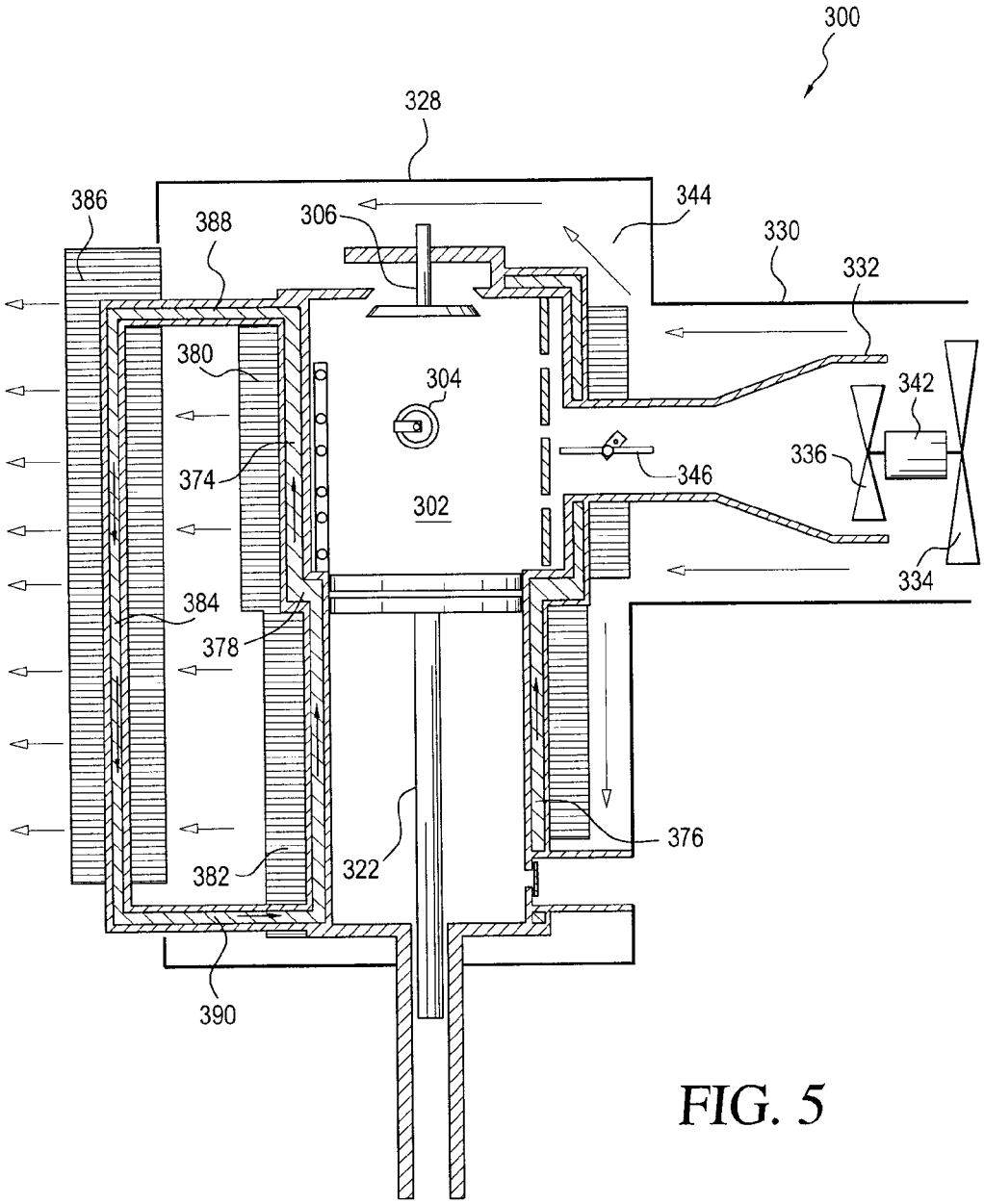
FIG. 5 is a schematic, vertical cross-sectional view, similar to that of FIG. 4, showing, however, a third embodiment of a new and improved fastener-driving tool as constructed in accordance with further principles and teachings of the present invention and showing the cooperative parts thereof, wherein, in addition to the sealed, recirculating liquid evaporation cooling system and cooling fin structure disclosed within FIG. 4, additional heat exchanger structure is also operatively associated with the recirculation passage of the cooling system.

With reference now being made to FIG. 5, a third embodiment of a new and improved fastener-driving tool, as constructed in accordance with further principles and teachings of the present invention and showing the cooperative parts thereof, is disclosed and is generally indicated by the reference character 300. It is to be noted that the third embodiment fastener-driving tool 300 as disclosed within FIG. 5 is operationally similar to the second embodiment fastener-driving tool 200 as disclosed within FIG. 4, except as will be noted hereafter, and accordingly component parts of the third embodiment fastener-driving tool 300 that correspond to component parts of the second embodiment fastener-driving tool 200 will be denoted by corresponding reference characters except that they will be in the 300 series. More particularly, it is seen that the primary difference between the third embodiment fastener-driving tool 300 and the second embodiment fastener-driving tool 200 resides in the fact that additional cooling fin or heat exchanger structure, in the form of a third set of annular cooling fins 386, is operatively associated with the recirculation passage 384 whereby, for example, the recirculation passage 384 passes axially through the set of annular cooling fins 386. It is also seen that upper and lower passages 388,390, respectively fluidically connecting the upper end portion of the first annular chamber 374 to the upper end portion of the recirculation passage 384, and the lower end portion of the recirculation passage 384 to the lower end portion of the second annular chamber 376, extend radially outwardly of the tool housing 328 such that the third set of annular cooling fins 386 is disposed externally of the tool housing 328 in order to permit the absorbed heat to radiate to atmosphere.

Figure 6:
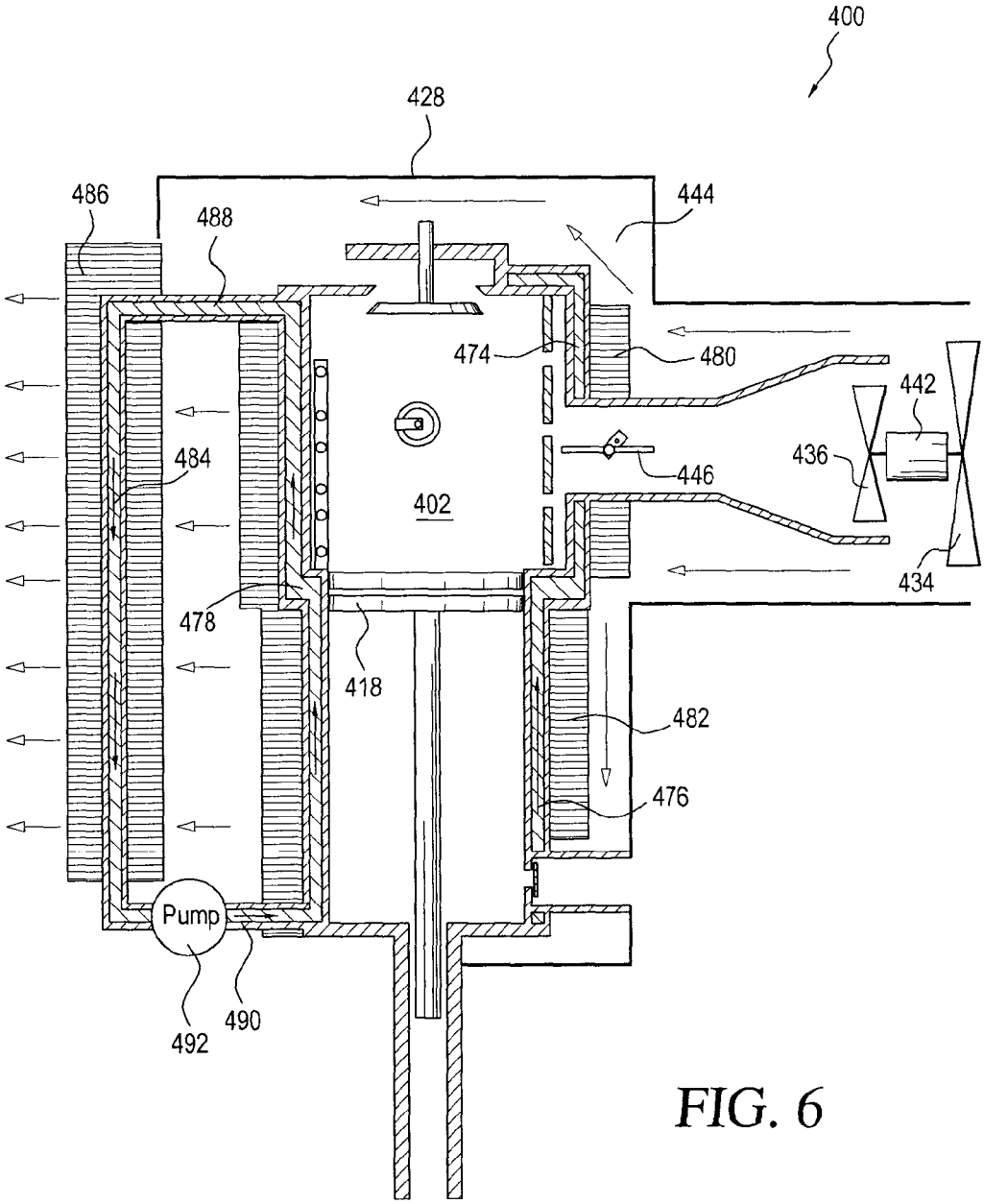
FIG. 6 is a schematic, vertical cross-sectional view, similar to that of FIG. 5, showing, however, a fourth embodiment of a new and improved fastener-driving tool as constructed in accordance with further principles and teachings of the present invention and showing the cooperative parts thereof, wherein a pump-driven liquid recirculating cooling system has been operatively associated with the fastener-driving tool.

With reference now being made to FIG. 6, a fourth embodiment of a new and improved fastener-driving tool, as constructed in accordance with further principles and teachings of the present invention and showing the cooperative parts thereof, is disclosed and is generally indicated by the reference character 400. It is to be noted that the fourth embodiment fastener-driving tool 400 as disclosed within FIG. 6 is similar in structure to the third embodiment fastener-driving tool 300 as disclosed within FIG. 5, except as will be noted hereafter, and accordingly component parts of the fourth embodiment fastener-driving tool 400 that correspond to component parts of the third embodiment fastener-driving tool 300 will be denoted by corresponding reference characters except that they will be in the 400 series. More particularly, it is seen that the primary difference between the fourth embodiment fastener-driving tool 400 and the third embodiment fastener-driving tool 300 resides in the fact that the cooling system of the fourth embodiment fastener-driving tool 400 comprises a recirculating liquid cooling system, comprising the recirculation of a suitable liquid, such as, for example, ethylene glycol, as opposed to the evaporative liquid cooling system, comprising the evaporation and condensation of a suitable liquid, such as, for example, alcohol, characteristic of, for example, the third embodiment fastener-driving tool 300. Accordingly, the first and second annular chambers 474,476 do not contain fabric or wick-type material, and since the liquid does not undergo a change in phase, such as, for example, evaporation and condensation, but will in fact be recirculated in its liquid state, a pump 492 is disposed within the lower passage 490, fluidically interconnecting the lower end portion of the recirculation passage 484 to the lower end portion of the second annular chamber 476, so as to in fact recirculate the liquid coolant throughout the entire recirculation system.

Figure 7:
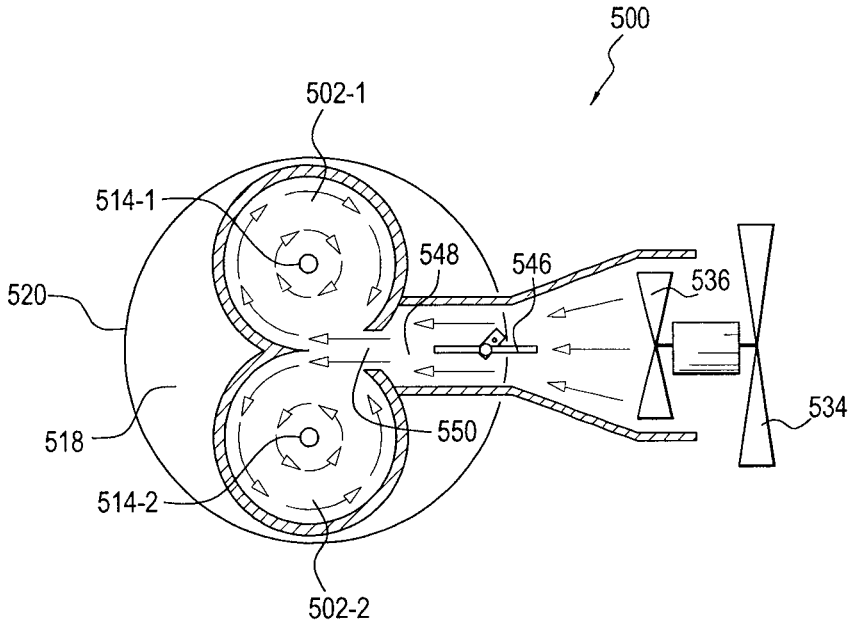
FIG. 7 is a schematic, horizontal cross-sectional view, similar to that of FIG. 2, showing, however, a fifth \embodiment of a new and improved fastener-driving tool, as constructed in accordance with further principles and teachings of the present invention and showing the cooperative parts thereof, wherein, in lieu of the single combustion chamber of the previous embodiments, the combustion chamber of this fifth embodiment fastener-driving tool comprises dual combustion chambers.

With reference lastly being made to FIG. 7, a fifth embodiment of a new and improved fastener-driving tool, as constructed in accordance with further teachings and principles of the present invention and showing the cooperative parts thereof, is disclosed and is generally indicated by the reference character 500. It is to be noted that the fifth embodiment fastener-driving tool 500 as disclosed within FIG. 7 is broadly structurally and operationally similar to, for example, the first embodiment fastener-driving tool 100 as disclosed within FIGS. 1-3, except as will be noted hereafter, and accordingly component parts of the fifth embodiment fastener-driving tool 500 that correspond to component parts of the first embodiment fastener-driving tool 100 will be denoted by corresponding reference characters except that they will be in the 500 series. More particularly, it is seen that the primary differences between the fifth embodiment fastener-driving tool 500 and the first embodiment fastener-driving tool 100 resides firstly in the fact that in lieu of the single combustion chamber 102 characteristic of the first embodiment fastener-driving tool 100, the fifth embodiment fastener-driving tool 500 comprises a pair of combustion chambers 502-1,502-2. It is seen that the incoming air is, in effect, simultaneously introduced into the pair of combustion chambers 502-1,502-2 through means of a single air intake manifold 548 and the plurality of air inlet ports 550 formed within a wall portion of the overall combustion chamber structure which is located at the juncture of the combustion chambers 502-1,502-2.

Secondly, it is noted that in lieu of the one or more fuel manifolds 114 being located adjacent to the internal peripheral wall surface of the combustion chamber 102 as can best be seen in FIGS. 2-3, each one of the combustion chambers 502-1,502-2 is respectively provided with a vertically oriented fuel manifold 514-1,514-2 which is located substantially at the axial center of its respective combustion chamber 502-1,502-2. Each one of the fuel manifolds 514-1,514-2 can have vertical arrays of fuel discharge ports disposed upon diametrically opposite sides thereof, and in this manner, the discharged fuel can be efficiently mixed with the incoming air for effectively forming an air-fuel mixture within each combustion chamber 502-1,502-2. The use of such single, axially located fuel manifolds, as illustrated by means of either fuel manifold 514-1 or 514-2 can also be implemented into either one of the preceding fastener-driving tool embodiments 100-400. It is lastly noted that the objective of using the dual combustion chambers 502-1,502-1, as opposed to the use of a single combustion chamber, is to try to maximize the efficiency and speed of igniting two relatively smaller air-fuel mixtures, as opposed to a single, relatively larger air-fuel mixture, wherein the ignited flame front travel paths are substantially shortened. It is also noted that ignition spark plugs, similar to, for example, spark plug 104, have of course been eliminated from illustration within the tool embodiment 500 of FIG. 7 solely for drawing clarity and simplification purposes.

Thus, it may be seen that in accordance with the principles and teachings of the present invention, there has been disclosed a new and improved combustion chamber and cooling system for a fastener-driving tool which comprises the use of a new and improved tangentially oriented, vortex induced fuel-injection system in conjunction with the tool's combustion chamber in order to enhance the mixing of the air-fuel mixture and to accelerate the combustion process within the combustion chamber so as to effectively reduce the time required from spark ignition to achieving peak combustion pressure within the combustion chamber, as well as for combustion product scavenging. In addition, a new and improved trigger-controlled valve actuating system, such as, for example, a switch-operated, solenoid-actuated valve-controlling system, is incorporated within the tool so as to ensure the rapid operation of the intake and outlet valve structures in order to, in turn, minimize tool firing operational cycles such that the combustion-powered fastener-driving tool can be operationally competitive with respect to conventional pneumatically-powered fastener-driving tools. Lastly, a sealed, liquid evaporative, or liquid recirculating, cooling system, in conjunction with cooling fin structure, is integrally incorporated upon or within the tool housing in order to impart added cooling to the tool.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A combustion-powered fastener-driving tool, comprising:

a combustion chamber defined around an axis and into which an air-fuel mixture is to be charged;

intake and exhaust valve means operatively associated with said combustion chamber and movable between first OPEN and second CLOSED positions for controlling the intake of air into said combustion chamber and the exhaust of combustion products out from said combustion chamber;

fuel injection means for injecting fuel into said combustion chamber and thereby forming an air-fuel mixture within said combustion chamber;

ignition means disposed within said combustion chamber for igniting the air-fuel mixture disposed within said combustion chamber;

a trigger mechanism; and a solenoid operated mechanism operatively connected to said intake and exhaust valve means for controlling the opening and closing of said intake and exhaust valve means with extremely quick movements, at appropriate times of a tool operational cycle, so as to effectively minimize the fastener-driving tool operational cycle times, wherein, said fuel injection means is disposed adjacent to a peripheral side wall portion of said combustion chamber such that said air and fuel respectively enter said combustion chamber from said air intake manifold and said fuel injection means in a tangential manner relative to said peripheral side wall portion such that the air-fuel mixture is conducted in accordance with a vortex type flow pattern within said combustion chamber.

2. The combustion-powered tool as set forth in claim 1, further comprising:

an air intake manifold fluidically connected to a peripheral side wall portion of said combustion chamber for admitting air into said combustion chamber; and an air duct fluidically connected to said air intake manifold so as to conduct air into said air intake manifold and into said combustion chamber;

said intake valve means being movably disposed within said air duct between said OPEN and CLOSED positions so as to permit air to flow into said air intake manifold and said combustion chamber when said intake valve means is disposed at said OPEN position with respect to said air duct, and to prevent air from flowing into said air intake manifold and said combustion chamber when said intake valve means is disposed at said CLOSED position with respect to said air duct.

3. The combustion-powered tool as set forth in claim 2, further comprising:

a housing surrounding said combustion chamber so as to define therewith an annular passageway;

an air intake duct connected to said housing; and a dual-fan system comprising a drive motor, a first fan for conducting air into said air duct fluidically connected to said air intake manifold so as to conduct air into said combustion chamber, and a second fan for cooling said drive motor as well as for conducting air into said annular passageway defined between said housing and said combustion chamber so as to cool external side wall portions of said combustion chamber.

4. The combustion-powered tool as set forth in claim 3, further comprising:

switch means interposed between said solenoid operated mechanism and said trigger mechanism for generating a signal to fire said tool when said trigger mechanism is properly actuated; and a programmable logic controller (PLC) operatively connected to said switch means for controlling said fuel injection means, said ignition means, said dual-fan system, and said solenoid operated mechanism and thereby said intake and exhaust valve means, in response to said signal generated by said switch means when said trigger mechanism is properly actuated.

5. A combustion-powered fastener-driving tool, comprising:

a combustion chamber defined around an axis and into which an air-fuel mixture is to be charged;

intake and exhaust valve means operatively associated with said combustion chamber and movable between first OPEN and second CLOSED positions for controlling the intake of air into said combustion chamber and the exhaust of combustion products out from said combustion chamber;

fuel injection means for injecting fuel into said combustion chamber and thereby forming an air-fuel mixture within said combustion chamber;

ignition means disposed within said combustion chamber for igniting the air-fuel mixture disposed within said combustion chamber;

a trigger mechanism; and a solenoid operated mechanism operatively connected to said intake and exhaust valve means for controlling the opening and closing of said intake and exhaust valve means with extremely quick movements, at appropriate times of a tool operational cycle, so as to effectively minimize the fastener-driving tool operational cycle times, wherein said combustion chamber comprises a pair of combustion chambers, wherein the combustion-powered fastener-driving tool further comprises a single air intake manifold which is defined at the juncture of said pair of combustion chambers so as to simultaneously introduce air into said pair of combustion chambers.

6. The combustion-powered tool as set forth in claim 5, wherein:

said fuel injection means is substantially disposed at the axial center of a respective one of said pair of combustion chambers.

7. The combustion-powered tool as set forth in claim 5, wherein:

the air intake manifold is fluidically connected to a peripheral side wall portion of said combustion chamber for admitting air into said combustion chamber, the combustion-powered tool further comprising an air duct fluidically connected to said air intake manifold so as to conduct air into said air intake manifold and into said combustion chamber, wherein said intake valve means being movably disposed within said air duct between said OPEN and CLOSED positions so as to permit air to flow into said air intake manifold and said combustion chamber when said intake valve means is disposed at said OPEN position with respect to said air duct, and to prevent air from flowing into said air intake manifold and said combustion chamber when said intake valve means is disposed at said CLOSED position with respect to said air duct.

8. A combustion-powered fastener-driving tool, comprising:

a combustion chamber defined around an axis and into which an air-fuel mixture is to be charged;

intake and exhaust valve means operatively associated with said combustion chamber and movable between first OPEN and second CLOSED positions for controlling the intake of air into said combustion chamber and the exhaust of combustion products out from said combustion chamber;

fuel injection means for injecting fuel into said combustion chamber and thereby forming an air-fuel mixture within said combustion chamber;

ignition means disposed within said combustion chamber for igniting the air-fuel mixture disposed within said combustion chamber;

a trigger mechanism; and a solenoid operated mechanism operatively connected to said intake and exhaust valve means for controlling the opening and closing of said intake and exhaust valve means with extremely quick movements, at appropriate times of a tool operational cycle, so as to effectively minimize the fastener-driving tool operational cycle times; and a recirculating cooling system, comprising a re-circulating cooling medium, operatively associated with said combustion chamber so as to cool said combustion chamber.

9. The combustion-powered tool as set forth in claim 8, wherein:

said fuel injection means is disposed adjacent to a peripheral side wall portion of said combustion chamber such that said air and fuel respectively enter said combustion chamber from said air intake manifold and said fuel injection means in a tangential manner relative to said peripheral side wall portion such that the air-fuel mixture is conducted in accordance with a vortex type flow pattern within said combustion chamber.

10. The combustion-powered tool as set forth in claim 8, wherein:

said recirculating cooling system comprises an evaporative/condensation type recirculating cooling system.

11. The combustion-powered tool as set forth in claim 8, wherein:

said recirculating cooling system comprises a pump for achieving recirculation of said re-circulating cooling medium.

12. The combustion-powered tool as set forth in claim 8, further comprising:

cooling fins operatively associated with said re-circulating cooling system and said combustion chamber for achieving additional cooling of said combustion chamber.

13. The combustion-powered tool as set forth in claim 8, wherein:

the recirculating cooling system is configured such that the re-circulating cooling medium flows around at least a substantial portion of an outside wall of the combustion chamber.

14. The combustion-powered tool as set forth in claim 8, wherein:

the recirculating cooling system is configured such that the re-circulating cooling medium flows around at least a portion of an outside wall of the combustion chamber.

15. A combustion-powered fastener-driving tool, comprising:

a combustion chamber defined around an axis and into which an air-fuel mixture is to be charged;

intake and exhaust valve system operatively associated with said combustion chamber and movable between first OPEN and second CLOSED positions for controlling the intake of air into said combustion chamber and the exhaust of combustion products out from said combustion chamber;

a fuel system configured to provide fuel into said combustion chamber and thereby forming an air-fuel mixture within said combustion chamber;

a trigger mechanism; and a solenoid operated mechanism operatively connected to said intake and exhaust valve system configured to control the opening and closing of said intake and exhaust valve system, wherein, the combustion-powered fastener-driving tool is configured such that the air-fuel mixture is conducted in accordance with a vortex type flow pattern within said combustion chamber; and the combustion-powered fastener-driving tool is configured such that air and fuel respectively enter the combustion chamber in a tangential manner relative to the peripheral side wall of the combustion chamber, thereby conducting the air-fuel mixture in the vortex type flow pattern.

16. The combustion-powered tool as set forth in claim 15, further comprising:

an air intake manifold fluidically connected to a peripheral side wall portion of said combustion chamber for admitting air into said combustion chamber; and an air duct fluidically connected to said air intake manifold so as to conduct air into said air intake manifold and into said combustion chamber;

said intake valve means being movably disposed within said air duct between said OPEN and CLOSED positions so as to permit air to flow into said air intake manifold and said combustion chamber when said intake valve means is disposed at said OPEN position with respect to said air duct, and to prevent air from flowing into said air intake manifold and said combustion chamber when said intake valve means is disposed at said CLOSED position with respect to said air duct.

* * * * *